US005271440A

United States Patent [19]

Bradstreet, Jr. et al.

[11] Patent Number: 5,271,440

[45] Date of Patent: Dec. 21, 1993

[54] CHIPPER DISC ASSEMBLY HAVING EXTENDED-LIFE REGRINDABLE DISPOSABLE KNIVES

[75] Inventors: Joseph R. Bradstreet, Jr., Vancouver, Wash.; Michael Cubbon, Portland, Oreg.; Ronald Danielson, Portland, Oreg.; Keith H. Hewitt, West Linn, Oreg.; David S. Macey, Gladstone, Oreg.

[73] Assignee: Pacific/Hoe Saw and Knife Company, Portland, Oreg.

[21] Appl. No.: 22,082

[22] Filed: Feb. 24, 1993

[51] Int. Cl.[5] ..... B27G 13/00; B27C 1/00

[52] U.S. Cl. ..... 144/176; 144/162 R; 144/218; 144/241; 241/92; 241/298; 407/41; 407/49; 407/102

[58] Field of Search ..... 144/162 R, 172, 174, 144/176, 218, 230, 241; 241/92, 298; 407/33, 43, 45, 48, 51, 52, 95, 96, 102, 41

[56] References Cited

U.S. PATENT DOCUMENTS

| | | | |
|---|---|---|---|
| 2,037,642 | 9/1933 | Scribner | 407/46 |
| 2,917,091 | 2/1958 | Smith et al. | 144/230 |
| 2,964,079 | 12/1960 | Johnson | 144/176 |
| 3,542,302 | 11/1970 | Salzmann, Jr. | 241/298 |
| 3,559,705 | 2/1971 | Salzmann, Jr. | 144/162 R |
| 3,785,417 | 1/1974 | Vora | 144/230 |
| 3,854,511 | 12/1974 | Maier | 144/230 |
| 3,976,271 | 8/1976 | Larsson et al. | 144/241 |
| 3,981,337 | 9/1976 | Sundstrom | 144/241 |
| 4,015,648 | 4/1977 | Shepard | 144/176 |
| 4,047,670 | 9/1977 | Svensson | 241/92 |
| 4,194,545 | 3/1980 | Kostermeier | 144/230 |
| 4,298,044 | 11/1981 | Hansel et al. | 144/176 |
| 4,349,057 | 9/1982 | Bachmann et al. | 144/230 |
| 4,351,487 | 9/1982 | Haller et al. | 241/92 |
| 4,423,758 | 1/1984 | Haller et al. | 144/176 |
| 4,449,556 | 5/1984 | Colton | 144/230 |
| 4,487,240 | 12/1984 | Bergler | 144/230 |
| 4,503,893 | 3/1985 | Demopoulos | 144/176 |
| 4,506,711 | 3/1985 | Armbruster et al. | 144/230 |
| 4,545,413 | 10/1985 | Sundberg et al. | 144/176 |
| 4,557,305 | 12/1985 | Berger et al. | 144/230 |
| 4,669,516 | 6/1987 | Carpenter et al. | 144/241 |
| 4,757,848 | 7/1988 | Mollberg, Jr. | 144/241 |
| 4,771,718 | 9/1988 | Carpenter et al. | 244/176 |
| 4,850,408 | 7/1989 | Carpenter et al. | 144/241 |
| 4,922,977 | 5/1990 | Colton | 144/230 |
| 4,997,018 | 3/1991 | Carpenter et al. | 144/241 |
| 5,146,963 | 9/1992 | Carpenter et al. | 144/241 |

*Primary Examiner*—W. Donald Bray
*Attorney, Agent, or Firm*—Klarquist, Sparkman, Campbell, Leigh & Whinston

[57] ABSTRACT

A knife assembly for a disc type wood chipper includes a reversible disposable knife having a serrated back bearing surface positioned between a serrated knife clamp and a flat counterknife. The knife can be reground and advanced along the serrated clamping surface of the clamp so as to maintain a desired edge position with respect to the surface of the chipper disc and the anvil surface.

3 Claims, 1 Drawing Sheet

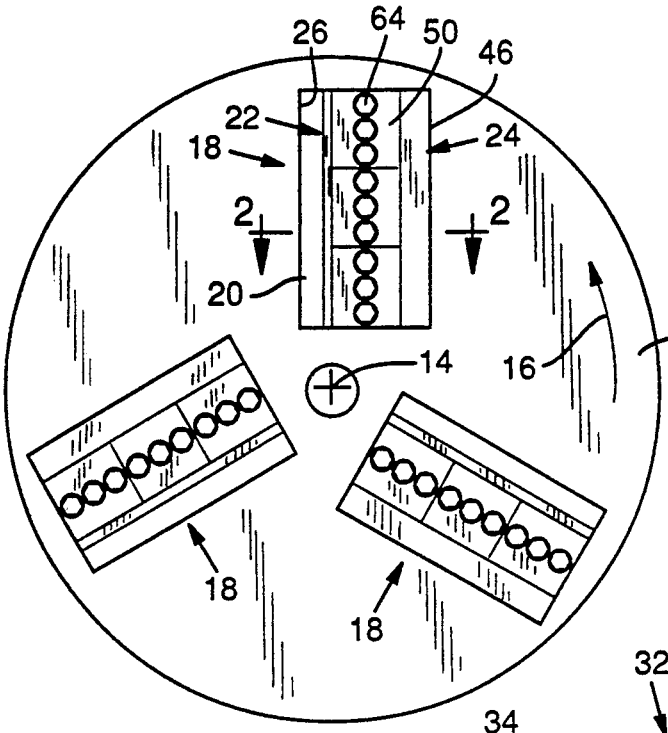
FIG. 1
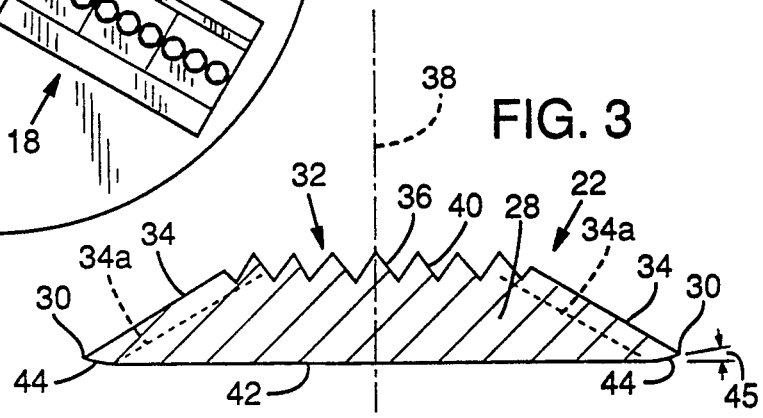
FIG. 3
FIG. 2
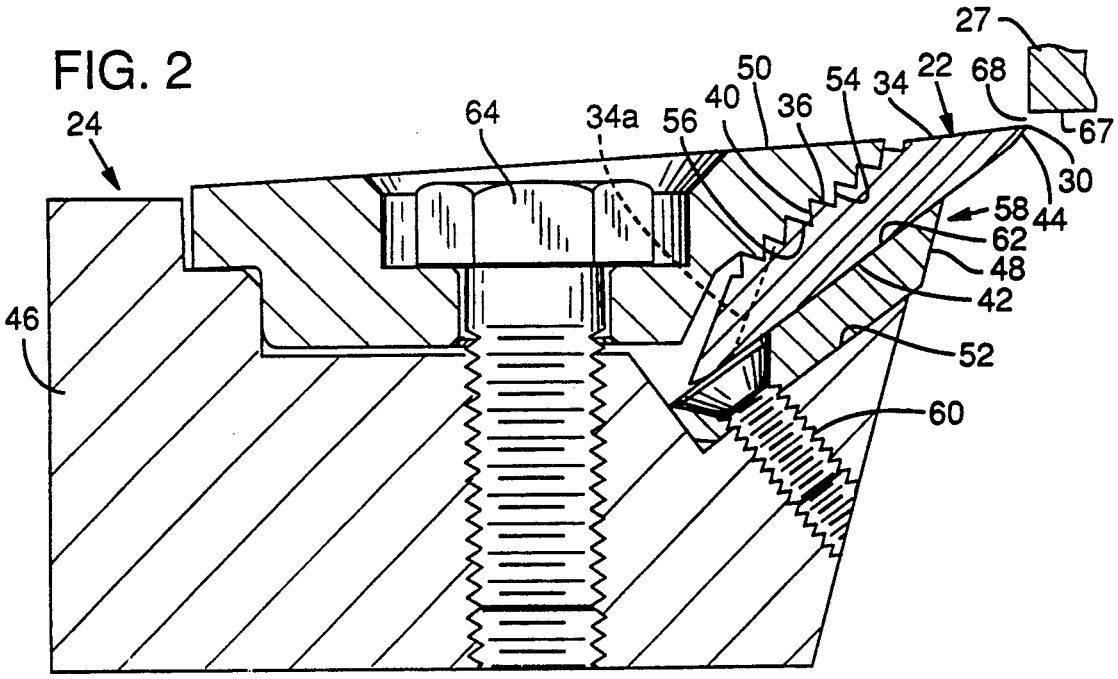

CHIPPER DISC ASSEMBLY HAVING EXTENDED-LIFE REGRINDABLE DISPOSABLE KNIVES

FIELD OF THE INVENTION

This invention relates to chipper apparatus and, more particularly, to disc type wood chippers which include a rotatably mounted chipper disc and one or more disposable knives mounted in a mounting and operable to produce wood chips upon feeding wood material against the surface of the chipper disc.

BACKGROUND OF THE INVENTION

A chipper disc and knife assembly utilizing double-edged reversible and disposable chipper knives is disclosed in Carpenter et al. U.S. Pat. No. 4,771,718. The knife featured in the Carpenter et al. assembly includes an elongated key-receiving channel on one of its sides which is relied upon to position the knife in place with respect to the chipper disc. While the assembly provides a double-edged chipper knife which can be securely mounted in a chipper disc, the knife itself cannot be reground and sharpened on the primary bevel while maintaining its cutting edge in the same relative position with respect to the surface of the chipper disc and anvil. This is because the counterknife in the Carpenter et al. assembly includes a key which, by its very nature, precludes relative motion radially between the knife and the mounting.

Knife and disc assemblies are known which utilize a knife having position adjusting serrations such that the knife can be adjustably positionable relative to a knife holding means. One such assembly is disclosed in Haller et al. U.S. Pat. No. 4,423,758. In the Haller et al. assembly, a reversible knife is mounted between a counterknife and a knife clamp. The knife has a flat surface which bears against a flat surface on the clamp. The opposite surface of the knife includes indented serrations which engage protruding serrations on the counterknife. Protruding serrations on a counterknife, however, tend to interfere with the cutting operation. They also tend to produce erratic chip sizes and generally interfere with the efficient operation of the assembly.

Serrations on the front side of a knife will also prevent it from being reground and sharpened, as the serrations would interfere with the grinding of the necessary edge reliefs as the body of the knife is reduced in size.

It is thus a principal object of the present invention to provide chipper apparatus of the type described with a reversible and sharpenable chipper knife and a mounting therefor, wherein the knife itself is adjustably positionable relative to the mounting such that the knife can be reground while maintaining its edge at the correct position relative to the surface of the chipper and the associated anvil.

It is a further object of the present invention to provide chipper apparatus of the type described wherein an adjustably positionable knife includes a bearing surface on its back side having indented serrations adapted cooperatively to engage protruding serrations on a clamping surface of a knife clamp.

A still further object of the present invention is to provide chipper apparatus of the type described having an adjustably positionable knife, with an absence of serrations on its front face, the apparatus thus being suitable for use with a counterknife without serrations, such that the assembly will not interfere in any way with the production of desirably sized wood chips.

SUMMARY OF THE INVENTION

The chipper apparatus of the instant invention includes a rotatably mounted chipper disc having a surface normal to the rotational axis thereof. The disc further includes at least one generally radially disposed opening extending into its surface, and the surface is positioned a predetermined distance from a log-retaining anvil.

The invention includes a reversible and sharpenable chipper knife which has an elongated knife body bounded on opposite sides by a pair of elongated cutting edges. The knife body has a back side defined by a pair of back knife surfaces extending inwardly of the knife body from the respective cutting edges. The back side has a bearing surface which includes indented serrations disposed therealong. The knife has a flat front side opposed and parallel to the bearing surface on the back side.

The apparatus provides a mounting for the knife. The mounting is disposed within the radially disposed opening in the disc surface. The mounting supports the knife within the opening and with one of the cutting edges of the knife disposed at a predetermined position outwardly of the disc surface and generally radially thereof and at a predetermined distance from the log-retaining anvil.

The mounting comprises a clamp having a clamping surface. The clamping surface includes protruding serrations. The clamping surface is adapted to bear against the back bearing surface of the knife with the protruding serrations on the clamp cooperatively engaging the indented serrations on the bearing surface of the knife.

The mounting further comprises a holder or base. The base includes a flat surface opposite and parallel to the clamping surface of the clamp. The flat surface of the base defines, with the clamping surface of the clamp, an opening in the mounting in which the knife is disposed.

The mounting further includes a counterknife disposed in the opening of the mounting. The counterknife is supported by the flat surface of the base. Means are provided to secure the counterknife to the base. The counterknife has a flat knife-engaging surface adapted to support the flat front side of the knife. The knife is disposed between the serrated clamping surface of the clamp and the flat knife-engaging surface of the counterknife.

The mounting further includes means for releasably clamping the serrated clamping surface of the clamp into engagement with the serrated bearing surface of the knife and with the flat front side of the knife into supporting engagement with the flat knife-engaging surface of the counterknife.

The construction makes it possible to advance the serrated bearing surface of the knife with respect to the serrated clamping surface of the clamp without otherwise affecting the counterknife. In this way the edges of the knife may be reground, yet the position of the cutting edge of the knife may be maintained at the desired location with respect to the surface of the chipper disc and the anvil. The absence of serrations on the counterknife results in an assembly wherein the front side of the knife is free of serrations which would interfere with the grinding of edge relief surfaces and which might otherwise interfere with its cutting action, and the counterknife is free of serrations which could produce erratically sized chips.

BRIEF DESCRIPTION OF THE DRAWINGS

FIG. 1 is a plan view of the face of a chipper disc suitable for use with the present invention and illustrates the reversible and sharpenable knives of the present invention and the mountings therefor;

FIG. 2 is an enlarged cross-sectional view taken generally along line 2—2 of FIG. 1 and illustrates the positioning of the chipper disc and the anvil and the mounting of a typical knife, all as contemplated by the instant invention; and FIG. 3 is a cross-sectional view of the double-edged reversible and sharpenable knife contemplated by the present invention.

DESCRIPTION OF THE PREFERRED EMBODIMENT

Referring to the drawings, FIG. 1 illustrates a chipper disc 10 having a substantially flat round disc surface 12 which forms the face of the disc and is normal to the rotational axis 14 thereof. Disc 10 is mounted in chipper apparatus for rotation in the direction of arrow 16. Three knife assemblies indicated generally by numeral 18 are illustrated as mounted in openings 20 which are generally radially disposed with respect to and extend into disc surface 12.

Each of knife assemblies 18 is illustrated as having three reversible and sharpenable knives 22 positioned in end-to-end relationship and aligned with each other in a mounting 24. Of course, the number of knives in an individual assembly can vary according to the needs of the installation, and the number of assemblies mounted in a disc can also vary. Disc 10 is provided with an opening 26 immediately in advance of each of knives 22 such that during operation, the knives 22 in each assembly 18 can shave wood chips from a piece of wood pressed against disc 10, the chips then traveling through openings 26 and then exteriorly of the chipper. Disc 10 is positioned adjacent the usual log-retaining anvil 27 as shown in FIG. 2.

Knife 22 itself is illustrated in cross-section in FIG. 3. It includes an elongated body 28 bounded on opposite margins by a pair of elongated cutting edges 30. Body 28 has a back side 32 defined by a pair of back knife surfaces 34 which extend inwardly of body 28 from the respective cutting edges 30. Body 28 further includes a bearing surface 36 which is generally perpendicular to the bisecting plane 38 of knife body 28. Bearing surface 36 includes a plurality of indented serrations 40 disposed along its full extent. Each of serrations 40 is generally triangular in cross-section. Knife 22 further includes a flat front side 42 which is opposed and parallel to bearing surface 36.

In a preferred embodiment, front side 42 is provided with ground reliefs 44 at each of its opposed edges 30. Each of reliefs 44 extends inwardly of the knife body 28 at an acute angle 45 with respect to front side 42. Angle 45 typically ranges from between about 4° to about 7° with respect to side 42 of knife 22.

Each of mountings 24 comprises a holder or base 46, a counterknife 48 and a clamp 50. Holder or base 46 includes a flat surface 52 which faces the direction of travel 16 and which is inclined with respect to the plane of disc surface 12.

Each of clamps 50 has a clamping surface 54 which is provided with protruding serrations 56 thereon. Surface 52 of holder 46 defines, with clamping surface 54 of clamp 50, an opening 58 in mounting 24 in which knife 22 and counterknife 48 are positioned.

Clamping surface 54 of clamp 50 is adapted to bear against back side bearing surface 36 of knife 22 with the protruding serrations 56 of clamping surface 54 cooperatively engaging the indented serrations 40 on the knife 22.

Counterknife 48 is positioned in opening 58 such that it can be supported by surface 52 of holder 46. Counterknife 48 is attached to holder 46 by flat head, countersunk screws 60 which extend along its length. Counterknife 48 can thus be provided with a flat knife-engaging surface 62 to support the flat front side 42 of knife 22, knife 22 engaging the serrated clamping surface 54 of clamp 50 and being supported by the counterknife 48.

Clamp 50, knife 22 and holder or base 46 are all held together by threaded fasteners 64. Thus clamping surface 54 of clamp 50 with its protruding serrations 56 is brought into releasable engagement with the corresponding serrations 40 on bearing surface 36 of knife 22, and the flat front side 42 of knife 22 is brought into supporting engagement with flat knife-engaging surface 62 of counterknife 48.

As mentioned above, each knife 22 has two cutting edges 30 such that the knife can be rotated 180° to present a fresh edge as required when both edges 30 are dull. The knife can then be removed for sharpening.

An example of a knife 22 constructed according to the present invention is one the width of whose front side 42 is 1.7 inches. Serrations 40 are 0.125 inch from point to point. Serrations 40 are positioned such that when back knife surfaces 34 are reground to the position of surfaces 34*a*, which are parallel to surfaces 34 and which bisect the side of the outermost serrations 40 (see the dashed lines 34*a* in FIG. 3), knife 22 may be replaced in opening 58, advanced with respect to serrated clamping surface 54 of clamp 50 (see the dashed line 34*a* in FIG. 2), such that when fastener 64 is again tightened, the new edge 30 will be in the same identical position with respect to disc surface 12 and surface 67 of anvil 27 as original edge 30 was in the original configuration. (In this installation the spacing 68 between surface 67 of anvil 27 and edge 30 of knife 22 is typically in the order of 0.006 inch.)

In this example the regrinding of surfaces 34 grinds away 0.125 inch from each back surface 34. The relationship between the position of the new edge 30 to counterknife 48, surface 67 of anvil 27 and clamp 50 remains identical to that which existed with respect to the original edge in the original configuration. The only difference is that knife 22 is two serrations less wide and, therefore, front side 42 is 0.25 inch less wide.

The invention thus makes it possible to achieve four cutting cycles for each knife 22, rather than the usual two, yet the edge of the reground knife will have the correct relative position as respects disc surface 12 and anvil surface 67. Each knife 22 thus has twice the cutting life of previously known knives, and the position of anvil 27 does not have to be reset after grinding. Such advantages have not heretofore been possible.

Furthermore, the absence of serrations on counterknife 48, together with the corresponding absence of serrations on front side 42 of knife 22, result in knife 22 being able to be reground without having serrations to interfere with the grinding of new relief surfaces 44, avoid deleterious cutting action, and also avoid production of erratic sized chips.

While there has been described herein a specific embodiment of the invention, changes and modifications may be made without departing from the spirit thereof.

We claim:

1. In cutting apparatus having rotatably mounted knife-holding means, the knife holding means including a first surface normal to the rotational axis of the knife-holding means, the means further including an opening extending into the first surface, the first surface being a predetermined distance from a surface of a workpiece support, a reversible knife comprising an elongated knife body bounded on opposite margins by a pair of original elongated cutting edges, the knife body having a back side defined by a pair of original back knife surfaces extending inwardly of the knife body from the respective cutting edges and a bearing surface including a pair of indented serrations each of which is adjacent a respective original back knife surface and a plurality of indented serrations disposed therebetween, the knife body further comprising a flat front side opposed and parallel to the bearing surface; and a mounting for the knife, the mounting being disposed within the opening in the first surface of the knife-holding means, the mounting supporting the knife within the opening in the first surface with one of the original cutting edges of the knife disposed at a predetermined position outwardly of the first surface, the mounting comprising a clamp having a clamping surface, the clamping surface of the clamp having protruding serrations thereon, the clamping surface of the clamp being adapted to bear against the bearing surface of the knife with the protruding serrations on the clamping surface of the clamp cooperatively engaging the indented serrations on the bearing surface of the knife, the mounting further comprising a base, the base comprising a flat surface opposite and parallel to the clamping surface of the clamp, the flat surface of the base defining, with the clamping surface of the clamp, an opening in the mounting in which the knife is disposed, the mounting further comprising a counterknife disposed in the opening of the mounting, the counterknife being supported by the flat surface of the base, the mounting further comprising means to secure the counterknife to the base, the counterknife having a flat knife-engaging surface adapted to support the flat front side of the knife, the knife being disposed between the serrated clamping surface of the clamp and the flat knife-engaging surface of the counterknife, the mounting further comprising means for releasably clamping the clamping surface of the clamp into engagement with the bearing surface of the knife and the flat front side of the knife into supporting engagement with the flat knife-engaging surface of the counterknife, the serrations on the bearing surface of the knife being so positioned that when the original back knife surfaces are reground to form new back knife surfaces which bisect the pair of serrations adjacent the original back knife surfaces, thereby to form a pair of new cutting edges, the bearing surface of the knife can be advanced with respect to the serrated clamping surface of the clamp, one of the pair of new cutting edges of the knife being disposed at the aforesaid predetermined position of the one original cutting edge of the knife with respect to the first surface of the knife-holding means and the surface of the workpiece support.

2. The apparatus of claim 1, wherein the cutting edges of the knife comprise flat relief surfaces each of which extends inwardly of the knife body at an acute angle with respect to the flat front side of the knife.

3. In cutting apparatus having knife-holding means adapted to position a knife having an edge positioned a predetermined distance from a surface of a workpiece support, a reversible knife disposed in the knife-holding means, the knife comprising an elongated knife body bounded on opposite margins by a pair of original elongated cutting edges, the knife body having a first side defined by a pair of original knife surfaces extending inwardly of the knife body from the respective cutting edges and a bearing surface disposed between the pair of original knife surfaces and including one pair of indented serrations each of which is adjacent a respective original knife surface and a plurality of indented serrations disposed therebetween, the knife body having a second side opposed and parallel to the bearing surface of the first side; and a clamp disposed in the knife-holding means, the clamp having a clamping surface, the clamping surface having protruding serrations thereon, the clamping surface of the clamp being adapted to bear against the bearing surface of the knife with the protruding serrations on the clamping surface of the clamp cooperatively engaging the indented serrations on the bearing surface of the knife, the clamp clamping the knife with one of the original cutting edges of the knife disposed at the predetermined distance from the surface of the workpiece support, the serrations on the bearing surface of the knife being so positioned that when the original knife surfaces are reground to form a pair of new knife surfaces which bisect the one pair of indented serrations adjacent the original knife surfaces, thereby to form a pair of new cutting edges, the bearing surface of the knife can be advanced with respect to the serrated clamping surface of the clamp, whereby one of the pair of new cutting edges of the knife is disposed at the aforesaid predetermined position of the one original cutting edge of the knife with respect to the surface of the workpiece support.

* * * * *

UNITED STATES PATENT AND TRADEMARK OFFICE

CERTIFICATE OF CORRECTION

PATENT NO. : 5,271,440

DATED : December 21, 1993

INVENTOR(S) : Joseph R. Bradstreet Jr., et al.

It is certified that error appears in the above-identified patent and that said Letters Patent is hereby corrected as shown below:

On the Title Page and column 1, line 1:

Delete the words "CHIPPER DISC" and substitute therefor --CUTTING--.

Signed and Sealed this

Thirteenth Day of September, 1994

*Attest:*

*Attesting Officer*

Bruce Lehman

BRUCE LEHMAN

*Commissioner of Patents and Trademarks*